United States Patent [19]

Firmani et al.

[11] Patent Number: 4,602,551

[45] Date of Patent: Jul. 29, 1986

[54] GATED ELECTRONIC METRONOME

[76] Inventors: Alexander D. Firmani, 700 Milltown Rd.; David R. Nelson, 8 Plover Ct., both of Wilmington, Del. 19808

[21] Appl. No.: 608,073

[22] Filed: May 7, 1984

[51] Int. Cl.[4] ..... G10B 15/00; G08B 3/00

[52] U.S. Cl. ..... 84/484; 340/384 E

[58] Field of Search ..... 84/484, 464 A, 1.03, 84/1.01, 1.02, DIG. 12; 340/384 E, 815.03

[56] References Cited

U.S. PATENT DOCUMENTS

| | | | |
|---|---|---|---|
| 3,818,693 | 6/1974 | Allard | 84/484 |
| 4,014,167 | 3/1977 | Hasegawa et al. | 340/384 E X |
| 4,018,131 | 4/1977 | Cannon | 84/484 |
| 4,193,257 | 3/1980 | Watkins | 84/484 |
| 4,204,400 | 5/1980 | Morohoshi et al. | 84/484 |
| 4,218,874 | 8/1980 | Ishida et al. | 84/484 |

*Primary Examiner*—L. T. Hix

*Assistant Examiner*—Douglas S. Lee

[57] ABSTRACT

A gated electronic metronome including an oscillator generating pulses for a counter that divides them to the fundamental tempo which is gated with a switch-selectable binary division of the fundamental tempo to produce an interrupted pattern of the fundamental tempo so a singer, player, drummer, etc. can monitor the error in his or her ability to maintain tempo without a reference.

6 Claims, 4 Drawing Figures

GATED ELECTRONIC METRONOME

BACKGROUND OF THE INVENTION

1. Field of Invention

This invention relates to a gated metronome which is useful as a practice and/or teaching aid for individuals and musical groups, providing a variety of interrupted (gated) tempos and the ability to change the duration of the interruption (interval) as well as the tempo itself.

2. Description of Prior Art

Heretofore, metronomes provided a constant visual and/or audible tempo display as disclosed in U.S. Pat. Nos. 4,193,257, 3,818,693, 4,018,131, 4,218,874, and 4,204,400. It had not been known that the electronic metronome had the ability to be gated, producing an interrupted tempo output at a rate proportional to and synchronous with the tempo itself.

The principle object of the present invention is to provide an electronic metronome having a gating circuit which interrupts the audible and visible tempo output, derived from a tempo signal generator, thereby making it easy for a singer, player, drummer, etc. to precisely monitor and develop the ability to keep time without a tempo reference.

It is another object of this invention to provide several durations of interrupt (intervals) so a singer, player, drummer, etc. may develop abilities gradually through different skill levels.

Further objects and advantages of the invention will become apparent from the drawings and ensuing description thereof.

BRIEF SUMMARY OF INVENTION

This invention is directed to a gated electronic metronome comprising oscillator means for providing a plurality of pulses at a rate multiple to a fundamental tempo, timing means in circuit association with said oscillator means for controlling the rate of said pulses, counting means for dividing the said plurality of pulses to the fundamental tempo, second counting means having a plurality of outputs for dividing the fundamental tempo into lower frequencies, circuit means for gating the fundamental tempo with the said lower frequencies to provide an interrupted pattern of the fundamental tempo, timing means in circuit association with said circuit means to produce a duty pulse output to drive audible and visible indicators, selector means connected between said second counting means and said circuit means operable to pass said lower frequencies from the said plurality of outputs to the said gating means according to manual selection of desired interval, further switch means incorporated in said selector means to generate reset pulses for said second counting means upon operation of said selector means.

DETAILED DESCRIPTION OF THE PREFERRED EMBODIMENTS

Figure 1:
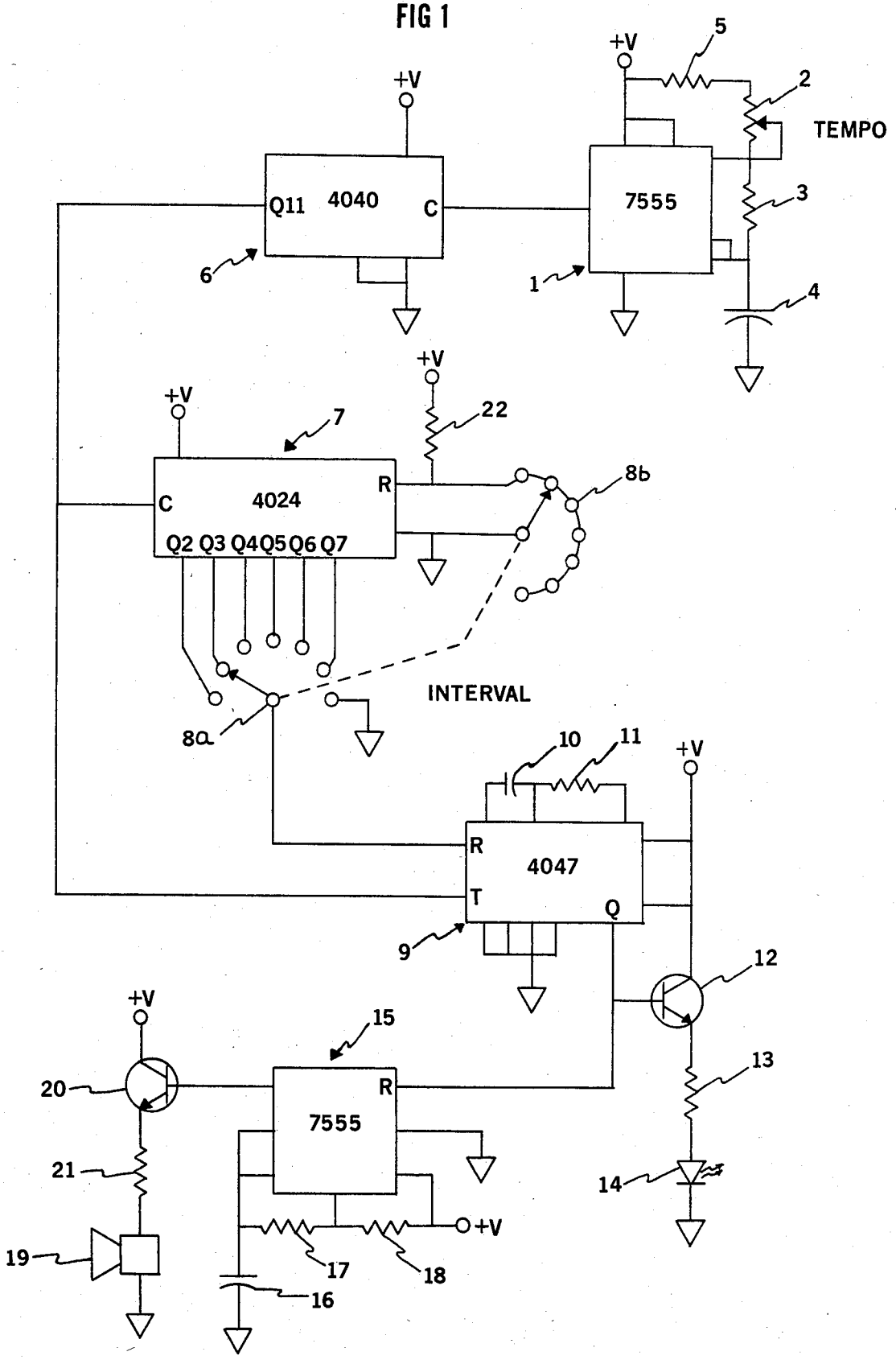
FIG. 1 is a circuit diagram showing an electronic metronome according to the invention.

FIG. 1 is a circuit diagram of an electronic metronome of the invention, in which this electronic metronome comprises an integrated circuit oscillator 1, producing a time-pulse signal adjustable within a predetermined frequency range by potentiometer control 2, at a rate 2,048 times the fundamental tempo. The frequency of oscillation is limited by the values of resistor 5 and resistor 3 which also determines the discharge rate for the timing capacitor 4.

A digital divider-counter 6 divides the oscillator's 1 output present at its clock input by 2,048 producing the fundamental tempo signal A (shown in FIG. 2) at its Q11 output adjustable within the range of 20 beats per minute to 208 beats per minute by potentiometer (tempo) control 2. This facilitates ease of fabrication and manufacture since the timing capacitor 4 will be smaller in value and size.

A second digital divider-counter 7 divides the fundamental tempo signal A (shown in FIG. 2) present at its clock input in a binary sequence of 4 through 128, respectively providing square wave outputs Q2 through Q7 synchronous with the negative-going edge of the clock. Outputs Q2 through Q7 are connected to one section 8*a* of a 2-pole non-shorting selector switch (interval) allowing connection of any output, by the user, to the reset (gating) input of monostable multivibrator 9.

Monostable multivibrator 9 is triggered on the positive-going edges of fundamental tempo signal A (shown in FIG. 2) when the reset (gating) signal B (shown in FIG. 2), provided from counter 7 through selector switch section 8*a*, is in the logic-low state. Positive-going duty pulses of a duration fixed by timing components 10 and 11 appear at the Q output C (shown in FIG. 2) of monostable multivibrator 9. Transistor 12, an emitter follower, conducts causing current to flow through limiting resistor 13 and light-emitting diode 14 providing the user a visual indication of the gated tempo signal.

The Q output of monostable multivibrator 9 also connects to the reset input of a second integrated circuit oscillator 15 that produces an audible frequency upon all logic-high signals. This frequency, determined by the values of timing components 16, 17, and 18, is applied to a transducer 19 through transistor emitter follower 20 and limiting resistor 21 providing the user an audible output of the gated tempo signal.

A logic-high state from counter 7 will reset monostable multivibrator 9 and inhibit pulses at its Q output. Thus the toggling outputs of counter 7 create the gating effect relative to the present invention.

Figure 2:
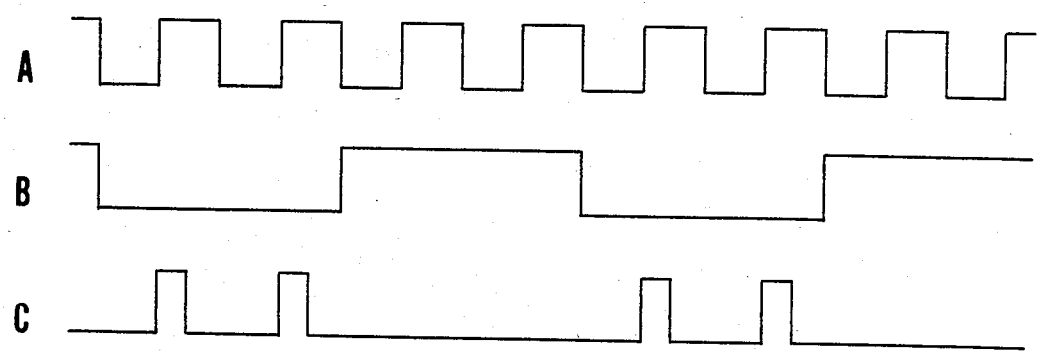
FIG. 2 is a timing graph representing waveforms in a gating circuit of the electronic metronome.

FIG. 2 depicts the metronome's waveforms when the interval switch 8*a* is set to connect the Q2 (divide-by-four) output B into the reset input of monostable multivibrator 9 creating two output pulses C per every four cycles of the fundamental tempo signal A.

Figure 3:
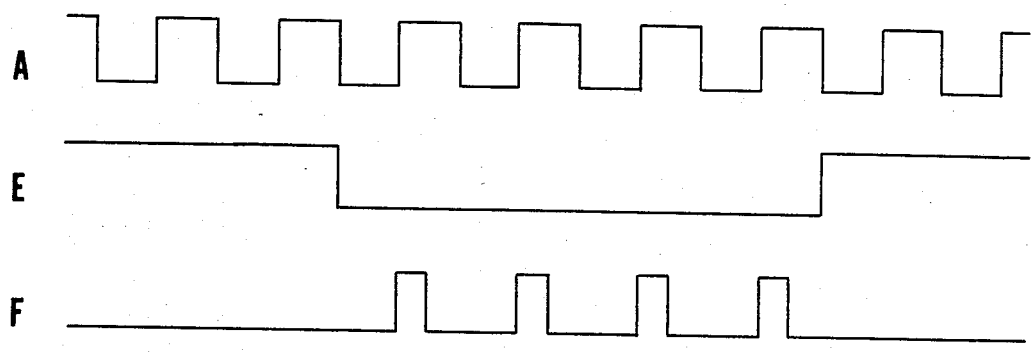
FIG. 3 is a timing graph further illustrating a gating circuit of the electronic metronome.

FIG. 3 depicts the metronome's waveforms when the interval switch 8*a* is set to connect the Q3 (divide-by-eight) output E into the reset input of monostable multivibrator 9 creating four output pulses F per every eight cycles of the fundamental tempo signal A.

It can be deduced from FIG. 1, FIG. 2, and FIG. 3 how the interval switch 8 and counter 7 provide skill levels for the user by generating a symmetrically-gated pattern of two to sixty-four tempo pulses relative to the present invention.

When the reset input of monostable multivibrator 9 is grounded via the interval switch 8 a continuous uninterrupted tempo output will be provided.

Figure 4:
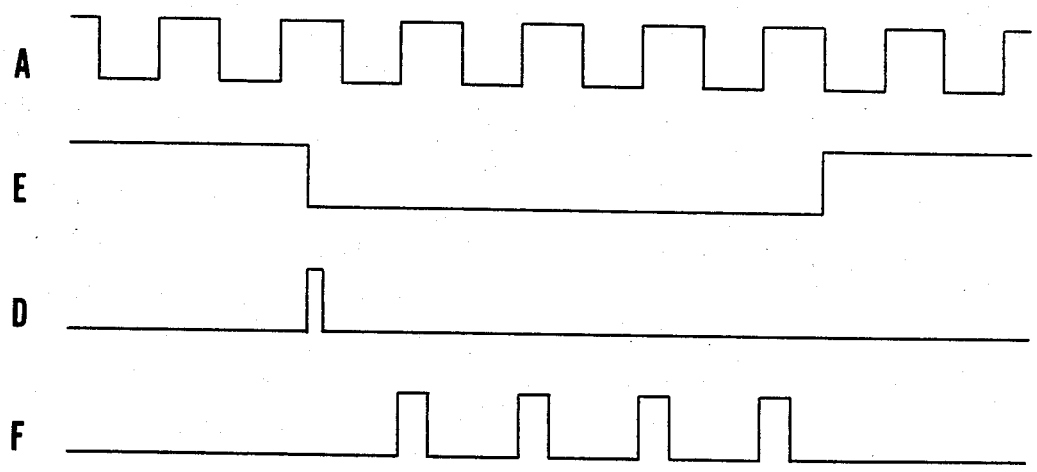
FIG. 4 is a timing graph representing waveforms developed during operation of the interval switch.

The second section of the interval switch 8*b* (FIG. 1) is wired to supply reset pulses to divider-counter 7. The non-shorting element provides an open circuit when rotated between steps allowing a logic-high reset pulse D (as shown in FIG. 4) through pullup action of resistor 22. This resetting ensures that tempo pulses will always occur immediately after the interval switch has been rotated (shown in FIG. 4) to another position eliminating random behavior at the metronome's outputs.

Current consumption of the present invention is low allowing operation with a standard 9-volt battery cell.

After applying power to the circuit of FIG. 1 a singer, player, drummer, etc. would adjust the tempo potentiometer 2 for the desired rate and rotate the interval selector switch 8 to select the desired beats per cycle. The singer, player, drummer, etc. would then perform to the tempo of the metronome's audible and visible outputs. The metronome will reach the silence portion of its cycle as the performer continues. The cycle will then end and the audible and visible outputs will become active allowing the performer to detect the error in his or her ability to maintain tempo without a reference.

While the above description contains many specificities, these should not be construed as limitations on the scope of the invention, but rather as an exemplification of one preferred embodiment thereof. Many other variations and improvements are possible such as large-scale integration of the electronics, linear phase locked loop voltage controlled tempo oscillator, and jacks for external amplifier or headset with associated volume control. Accordingly, the scope of the invention should be determined not by the embodiment illustrated, but by the appended claims and their legal equivalents.

What is claimed is:

1. A gated electronic metronome comprising pulse providing means for providing a plurality of pulses at a selected rate multiple to a fundamental tempo; first counting means, in circuit association with said pulse providing means, for dividing said plurality of pulses to the fundamental tempo; second counting means, associated to receive pulses at the fundamental tempo from said first counting means, said second counting means dividing said pulses at the fundamental tempo into lower frequencies and having a plurality of outputs for said lower frequencies; circuit means associated to receive as inputs the pulses at the fundamental tempo from said first counting means and pulses at a selected lower frequency from said second counting means, said circuit means gating said pulses at the fundamental tempo with said pulses at the lower frequency to provide at an output thereof an interrupted pattern of pulses at the fundamental tempo; audible and visual indicators associated with the output of said circuit means and driven by said interrupted pattern of pulses; selector switch means connected between the output of said second counting means and the input of said circuit means for selecting one or more of said outputs of said second counting means thereby providing adjustment for said interrupted pattern of pulses at the fundamental tempo; further switch means incorporated in said selector switch means providing reset pulses for said second counting means upon operation of said selector switch means for eliminating random behavior of said interrupted pattern of pulses at the fundamental tempo.

2. The gated electronic metronome of claim 1 wherein said circuit means includes monostable multivibrators with a plurality of inputs for logically gating fundamental tempo pulses, from said first counting means, with said lower frequency pulses, from said second counting means.

3. The gated electronic metronome of claim 1 wherein said lower frequencies are related to said fundamental tempo as binary divisions thereof.

4. The gated electronic metronome of claim 1 wherein said interrupted pattern is synchronous with said fundamental tempo.

5. The gated electronic metronome of claim 2 wherein said lower frequencies are related to said fundamental tempo as binary divisions thereof.

6. The gated electronic metronome of claim 5 wherein said interrupted pattern is synchronous with said fundamental tempo.

* * * * *